US009580258B1

(12) United States Patent
McFarland et al.

(10) Patent No.: US 9,580,258 B1
(45) Date of Patent: Feb. 28, 2017

(54) REMOVABLE MEDIA TRAY HAVING A MEDIA RESTRAINT WITH SLIDING CAMS AND PIVOTING LATCHING CAMS OPERABLE WITHOUT THE USE OF PINCHING

(71) Applicant: LEXMARK INTERNATIONAL, INC., Lexington, KY (US)

(72) Inventors: Neal Douglas McFarland, Versailles, KY (US); Dustin Daniel Fichter, Versailles, KY (US); Stacey Vaughan Mitchell, Lexington, KY (US); Hannibal Bartolata Aljecera, Mandaue (PH); Winston Bercades Gomez, Dumaguete (PH); Pat Marlon Cartagena Limosnero, Minglanilla (PH); Lowell Libo-On Tacadao, Mandaue (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/060,878

(22) Filed: Mar. 4, 2016

(51) Int. Cl.
*B65H 1/00* (2006.01)
*B65H 1/04* (2006.01)

(52) U.S. Cl.
CPC ..... *B65H 1/04* (2013.01); *B65H 2405/112* (2013.01); *B65H 2405/1116* (2013.01);
(Continued)

(58) Field of Classification Search
CPC ... B65H 1/00; B65H 1/04; B65H 9/04; B65H 9/06; B65H 2405/111; B65H 2405/1116; B65H 2405/112; B65H 2405/1122; B65H 2405/1124; B65H 2405/113; B65H 2405/1134; B65H 2405/114; B65H 2405/1142; B65H 2405/11425; B65H 2405/1144; B65H 2405/12; B65H 2405/121; B65H 2511/00; B65H 2511/10; B65H 2511/11; B65H 2511/12
See application file for complete search history.

(56) References Cited

U.S. PATENT DOCUMENTS 8,052,141 B2 * 11/2011 Yamagishi ..... B65H 1/266 271/171
8,622,383 B2 * 1/2014 Lee ..... B65H 1/266 271/171

(Continued)

*Primary Examiner* — Prasad Gokhale
(74) *Attorney, Agent, or Firm* — John Victor Pezdek

(57) ABSTRACT

A media restraint for a removable media tray and slidably operable without the use of a pinching force. The media restraint slidably positionable on a track in a removable media tray and is operable without pinching. A pair of pivoting latching cams are used to engage the media restraint to the track and have serrated portions pivotally mounted to a bottom of the media restraint. The media restraint is operable by a finger of the user applying a downward force to an actuator that spreads two cam plates apart which in turn pivot the pair of latching cams to release the media restraint from the track and allowing it to be moved along the track. Upon removal of the downward force, a biasing member lifts the actuator to bring the two cam plates back to their first positions thereby pivoting the pair of latching cams back to reengage with the track.

13 Claims, 6 Drawing Sheets

(52) U.S. Cl.
CPC ..... *B65H 2405/1122* (2013.01); *B65H 2405/1134* (2013.01); *B65H 2405/1144* (2013.01); *B65H 2405/11425* (2013.01); *B65H 2405/12* (2013.01); *B65H 2405/121* (2013.01); *B65H 2511/11* (2013.01)

(56) References Cited

U.S. PATENT DOCUMENTS

| | | | | |
|---|---|---|---|---|
| 2004/0135306 | A1* | 7/2004 | Takahashi | B65H 1/04 271/145 |
| 2008/0298873 | A1* | 12/2008 | Yamagishi | B65H 1/266 400/624 |
| 2009/0243206 | A1* | 10/2009 | Ueyama | B65H 1/266 271/264 |
| 2010/0052247 | A1* | 3/2010 | Kaseda | B65H 1/266 271/226 |
| 2013/0161898 | A1* | 6/2013 | Lee | B65H 1/266 271/145 |
| 2015/0274449 | A1* | 10/2015 | Fukunaga | B65H 9/08 271/241 |

* cited by examiner

REMOVABLE MEDIA TRAY HAVING A MEDIA RESTRAINT WITH SLIDING CAMS AND PIVOTING LATCHING CAMS OPERABLE WITHOUT THE USE OF PINCHING

CROSS REFERENCES TO RELATED APPLICATIONS

The present disclosure is related to U.S. patent application Ser. No. 15/060,860, entitled "REMOVABLE MEDIA TRAY HAVING A MEDIA RESTRAINT WITH LATCHING PLUNGER OPERABLE WITHOUT THE USE OF PINCHING" filed Mar. 4, 2016; and U.S. patent application Ser. No. 15/060,868, entitled "REMOVABLE MEDIA TRAY HAVING A MEDIA RESTRAINT WITH TRANSLATING LATCHING CAMS OPERABLE WITHOUT THE USE OF PINCHING" filed Mar. 4, 2016, each assigned to the assignee of the present disclosure.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device having a removable media tray with an adjustable media restraint.

Description of the Related Art

In 1998, Congress amended the Rehabilitation Act of 1973 (29 U.S.C. §794 (d)) to require Federal agencies to make their electronic and information technology accessible to people with disabilities. Section 508 of the Rehabilitation Act applies to all federal agencies when they develop, procure, maintain, or use electronic and information technology. Under Section 508, federal agencies must give disabled employees and members of the public access to information that is comparable to access available to others. These provisions apply to operable controls which are defined as components of a product that require physical contact for normal operation. Operable controls include, but are not limited to, media restraints. Operable controls are to be operable with one hand and not require tight grasping, pinching, or twisting of the wrist. Thus, under these requirements, the media restraint needs to be operable without the use of a pinching force.

Media restraints in removable media trays are typically provided along a bottom and side edge of a media area within the removable media tray for holding the media in place for feeding into an imaging device. The media restraints are moveable along tracks in the removable media tray to accommodate different media sizes. These media restraints are operated by a user pinching an actuation member or lever to release the media restraint from engagement with the track, and, while still pinching the actuation member or lever, moving the media restraints to a new position in the removable media tray.

It would be advantageous to have a media restraint that can be operated without the use of a pinching force. It would be further advantageous, that such a media restraint would also be moveable using a single finger.

SUMMARY OF THE INVENTION

Disclosed is a removable media tray having a media restraint that is operable without the use of a pinching force. The removable media tray comprises a bottom surface for holding media to be fed to the imaging device, a track having a plurality of teeth along a length of the track and positioned on the bottom surface, and, a media restraint slidably engageable with the track. The media restraint includes a bottom plate having a first opening therethrough, a front plate and a rear plate each depending from the bottom plate, and, a latching mechanism. The latching mechanism includes an actuator, first and second sliding cam plates, first and second latching cams and a biasing member. The actuator is slidably received between the front and rear plates and has a first position adjacent the top plate. The actuator has a vertical member and a horizontal member attached to a bottom end of the vertical member and extending outwardly from each side of the vertical member. An upper end of the vertical member has a button depending therefrom and aligned with the second opening. The horizontal member has a first and a second cam follower depending therefrom. The first sliding cam plate has a first angled slot and a first pivot member and the second sliding cam plate has a second angled slot and a second pivot member. The first and the second sliding cam plates are vertically disposed such that the first and the second cam followers are received into and are slidable along the first and the second slots with the first and the second cam followers being adjacent an upper end of the first and the second slots when the actuator is in its first position. The first and second latching cams each have a serrated portion engaging with the track and are pivotally mounted to the bottom plate at respective first ends. The first and second latching cams have a first and a second slot, respectively, at respective second ends with the slots receiving therein the first and second pivot members extending through the first opening. The first and second latching cams have respective first positions being engaged with the track when the actuator is in its first position. The biasing member biases the actuator and the first and the second latching cams in their respective first positions.

Upon application of a user-supplied downwardly directed force to the button, the actuator moves from its first position and translates downwardly with the first and second cam follower sliding down the first and second slots, pivoting the first and second latching cams about their respective first ends and away from their respective first positions and moving the serrated portions of the first and the second latching cams away from the track allowing the media restraint to be translated along the track. When the downwardly directed force is removed, the biasing member returns the actuator and the first and second latching cams to their respective first positions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 3A shows an engaged position and FIG. 3B shows an actuated or disengaged position for the media restraint.

FIG. 4A illustrates the media restraint in its first or engaged position and FIG. 4B illustrates the media restraint in an actuated or disengaged position.

FIG. 5A illustrates the media restraint in its first or engaged position and FIG. 5B illustrates the media restraint in an actuated or disengaged position.

FIG. 6A shows the media restraint in an engaged position and FIG. 6B shows the media restraint in an actuated or disengaged position.

FIG. 7A shows the latching mechanism in an engaged position and FIG. 7B shows the latching mechanism in an actuated or disengaged position.

DETAILED DESCRIPTION

Figure 1:
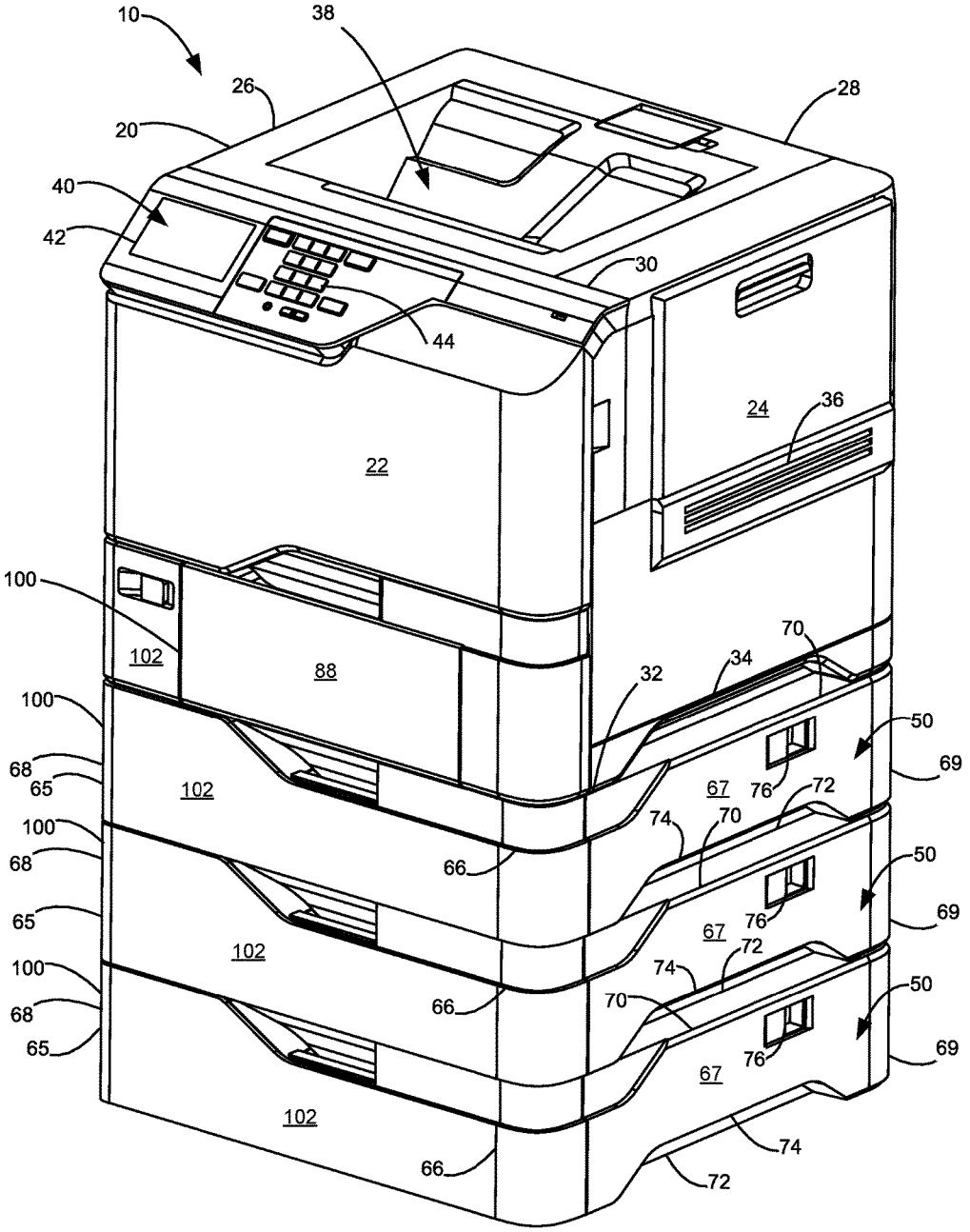
FIG. 1 is an illustration of the imaging device having a removable media tray attached to a stack of option assemblies each of which also have a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "spring seat" or "spring mount" are used interchangeably.

FIG. 1 illustrates an example imaging device 10 atop three example option assemblies 50. Imaging device 10 has a housing 20 having a front 22, a first and second sides 24, 26, a rear 28, a top 30 and a bottom 32 and into which a removable media tray 100 is slidably inserted. Option assembly 50 has a housing 65 having a front 66, a first and second sides 67, 68, a rear 69, a top 70 and a bottom 72 and into which removable media tray 100 is slidably inserted. A user interface 40 comprising a display 42 and a key panel 44 may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100 in imaging device 10 and may be used for handling envelopes, index cards or other media where only a small number of the media will be printed. The multipurpose tray 88 may also be incorporated into front 22 of housing 20 rather than being incorporated into removable media tray 100. Hand grips 34, 74 are provided in several locations on housings 20, 65, respectively, such as on sides 24, 26, 67, 68. Also, ventilation openings, such as vents 36 are provided on imaging device 10 such as those shown on first side 24. Latches 76 are provided on each option assembly 50 to secure it to either imaging device 10 or a superior option assembly 50 in the stack.

Option assemblies 50 may be removed or added to the stack. As each option assembly 50 is added, the media path is extended. The option assemblies 50 are stackable allowing one or more option assemblies 50 to be used with a single imaging device 10. An additional option assembly 50 is typically positioned on top of the uppermost option assembly 50 in the stack. Typically, each option assembly 50 may contain a different type of media such as letterhead or a different size such as A4 or a larger quantity of the same media type that is found in the removable media tray 100 integrated into imaging device 10. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, 8½"×11", A4, and 11"×17". In some instances, the removable media tray 100 in imaging device 10 may hold a lesser, equal or greater quantity of media than a removable media tray 100 found in an option assembly 50.

Figure 2:
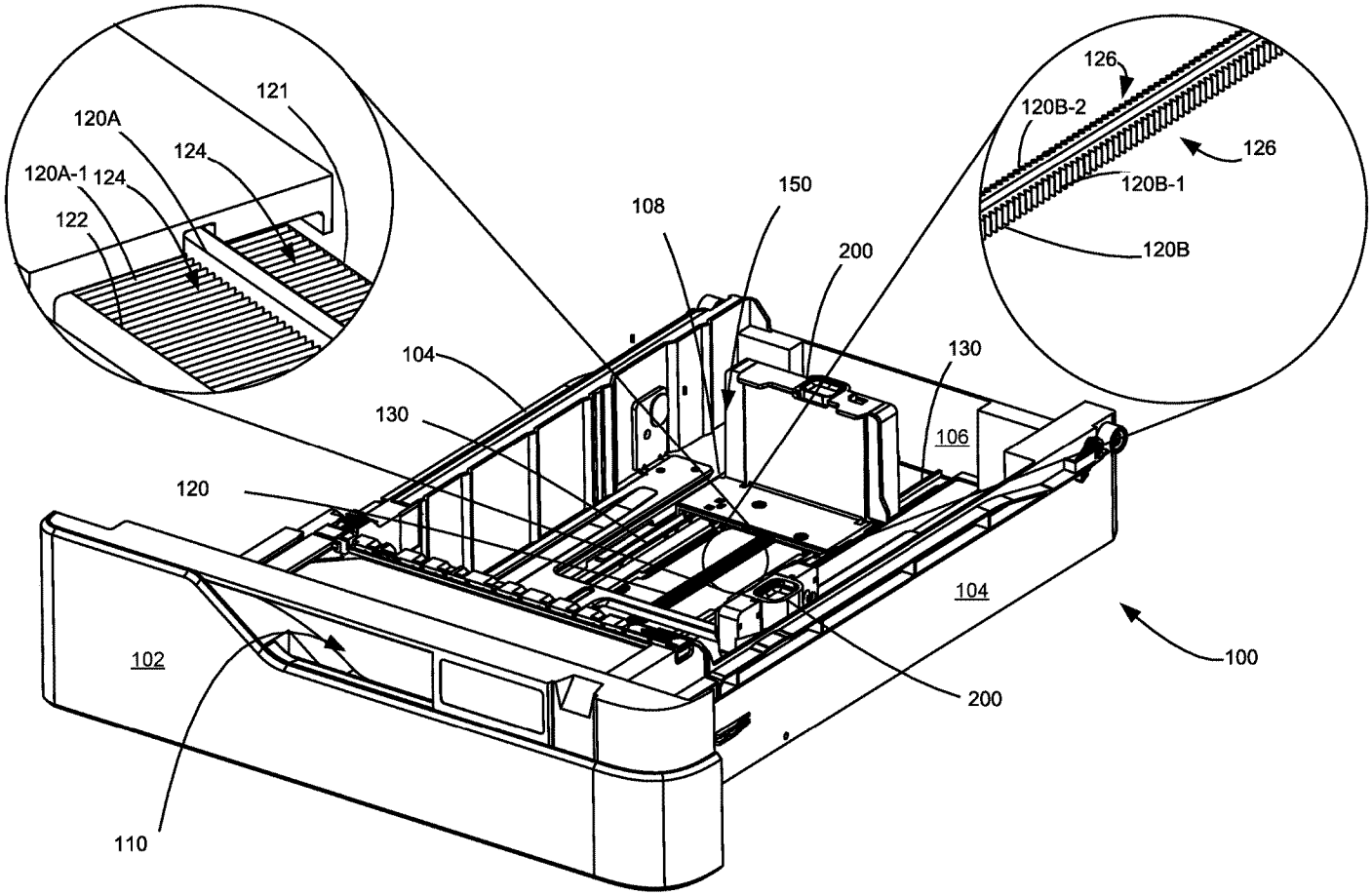
FIG. 2 is a perspective illustration of a removable media tray for the imaging device of FIG. 1 having a rear and side edge media restraint of the present disclosure and two insets showing track configurations useable with a media restraint.

Referring to FIG. 2, removable media tray 100 is shown. Removable media tray 100 is sized to hold approximately 550 pages of 20 pound media which has a media stack height of about 59 mm. Removable media tray 100 has a front wall 102, side walls 104 and a rear wall 106 depending from a bottom 108. Media storage area 150 is generally defined by front wall 102 and side walls 104, and bottom 108. Provided in each removable media tray 100 are one or more adjustable media restraints 200, shown to be placed at a rear and a side edge of the media storage area 150, to accommodate different media widths and lengths. A handle 110 is provided in front wall 102 for removing and inserting removable media tray 100 into imaging device 10 or option assembly 50.

Provided on the bottom 108 of removable media tray 100 is a track 120 on which media restraint 200 travels and latches. The insets in FIG. 2 show two configurations of the track 120. The left inset shows a track 120A having a plurality of horizontal serrations or teeth 124 across the top 120A-1 thereof. Track 120A is also illustrated as having two parallel sections 121, 122 each having a plurality of horizontal serrations 124. The right inset shows a track 120B having a plurality of vertical serrations or teeth 126 along at least one of its sides. As shown, serrations 126 are provided on each of its sides 120B-1, 120B-2. Media restraint 200 engages with the track 120 using a later described latching mechanism that engages with serrations 124 or serrations 126. One or more guide rails 130 may also be provided on the bottom 108 for guiding the media restraint 200 as it is moved between positions along track 120.

Figure 3B:
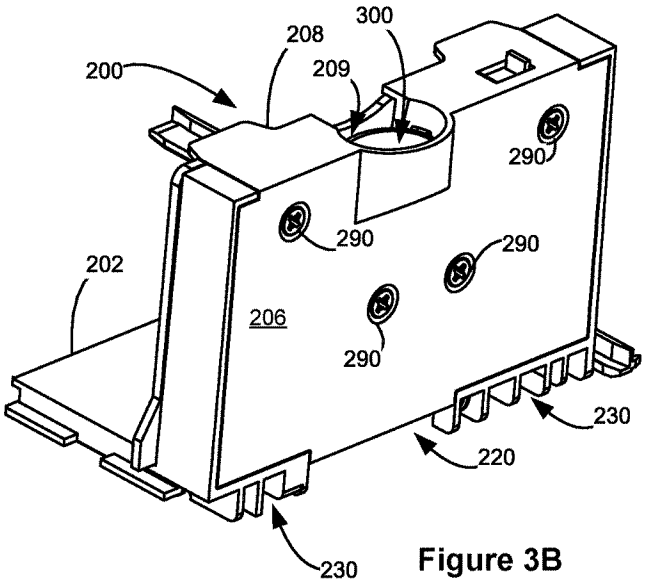
FIGS. 3A-3B are front and rear views of the media restraint of the present disclosure where
Figure 3A:
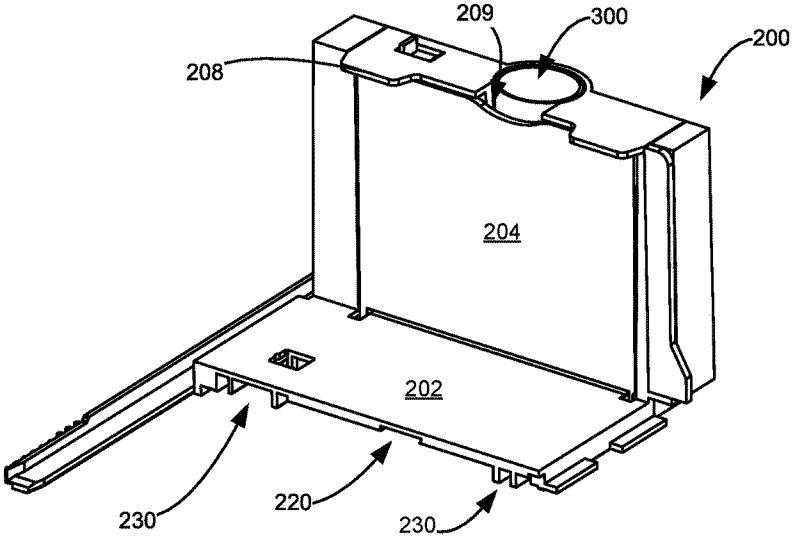

Referring to FIGS. 3A-3B, media restraint 200 has a bottom plate 202 which travels along track 120B and guide rails 130. Channels 220 and 230 are provided in the undersurface of bottom plate 202 and are sized to receive track 120B and guide rails 130, respectively. Depending from bottom plate 202 are a front plate 204 and a rear plate 206 that are joined by a top plate 208. A support plate 250 is shown attached to the undersurface of bottom plate 202 by fasteners 290. A latching mechanism 300 is mounted between the front and rear plates 204, 206 and is used to engage the media restraint 200 to the track 120B. An opening 209 is provided in top plate 208 to access latching mechanism 300. Top plate 208 may be integrally molded as part of rear plate 206 or as part of front plate 204. Rear plate 206 is attached to front plate 204 by one or more fasteners 290. Four fasteners 290 are shown.

Figure 6A:
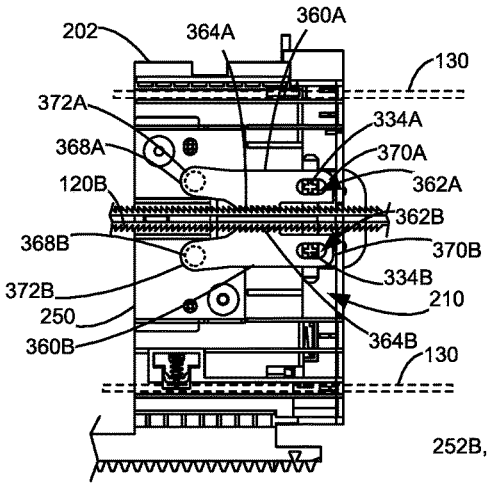
FIGS. 6A-6B are bottom views of the media restraint of the present disclosure where
Figure 6B:
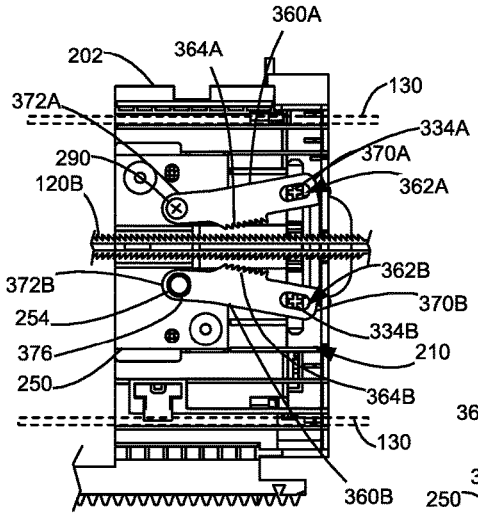
Figure 7B:
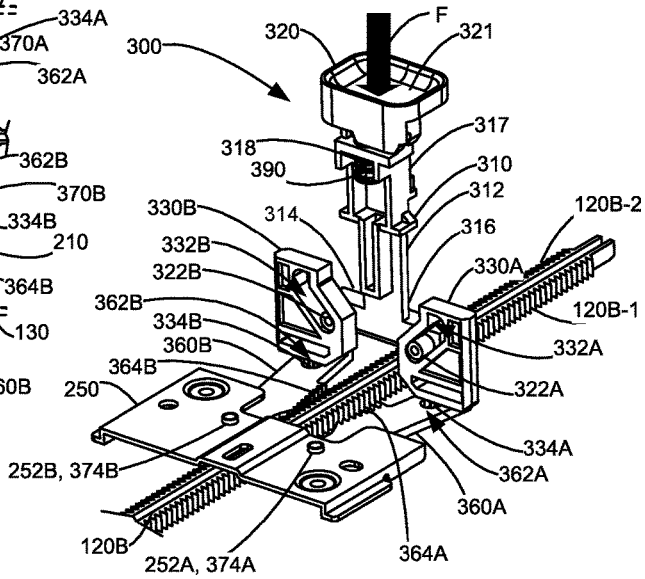

Referring to FIGS. 4A-7B, latching mechanism 300 is shown. Latching mechanism 300 includes an actuator 310, a first and a second sliding cam plate 330A, 330B, a first and a second latching cam 360A, 360B, and a biasing member 390. Actuator 310 is slidably received between the front and rear plates 204, 206 in recess 212 (see FIG. 4A for example) and has a first position adjacent to the top plate 208. The actuator 310 has a vertical member 312 and a horizontal member 314 attached to a bottom end 316 of the vertical member 312 and extending outwardly from each side of the vertical member 312 in an inverted capital T configuration. An upper end 317 of the vertical member 312 has a button 320 depending therefrom and aligned with the opening 209 in top plate 208 (see FIGS. 3A-3B). Provided adjacent to the upper end 317 of vertical member 312 is a spring seat 318 for biasing member 390. Button 320 has a concave surface 321 for receiving a fingertip of a user of the media restraint 200. A first and a second cam follower 322A, 322B shown in FIGS. 7A-7B are provided adjacent the ends of horizontal member 314. The first and second cam followers 322A, 332B are illustrated as being cylinders projecting parallel to bottom plate 202 and into recess 212.

First and second sliding cam plates 330A, 330B are positioned vertically and adjacent to horizontal member 314. First and second sliding cam plates 330A, 330B each have first and second angled slots 332A, 332B arranged in a V-shaped pattern. First and second slots 332A, 332B are sized to slidably receive respective first and second cam followers 322A, 322B. First and second pivot members 334A, 334B downwardly project from the bottom of sliding cam plates 330A, 330B. First and second sliding cam plates 330A, 330B are mirror images of one another about track 120B or vertical member 312.

First and second sliding cam plates 330A, 330B are respectively mounted on and connected to first and second latching cams 360A, 360B via first and second pivot members 334A, 334B as seen in FIGS. 6A-7B that are received into corresponding slots 362A, 362B provided near respective first ends 370A, 370B of first and second latching cams 360A, 360B. First and second sliding cam plates 330A, 330B are translatable within opening 210 provided in bottom plate 202. Positioned about track 120B or vertical member 312, first latching cam 360A and first sliding cam plate 330A are configured in a mirror image arrangement with second latching cam 360B and second sliding cam plate 330B. First and second latching cams 360A, 360B are planar.

Positioned between first and second ends 370A, 372A of first latching cam 360A is a serrated portion 364A which engages with track 120B. Positioned between first and second ends 370B, 372B of second latching cam 360B is a serrated portion 364B which engages with track 120B. First and second pivot pins 374A, 374B are provided adjacent to respective second ends 372A, 372B of first and second latching cams 360A, 360B. First and second pivot pins 374A, 374B are received into respective first and second openings 214A, 214B provided in support plate 250 or in bottom plate 202 (see FIG. 3A) allowing the first and second latching cams 360A, 360B to pivot with respect to track 120B.

Figure 8:
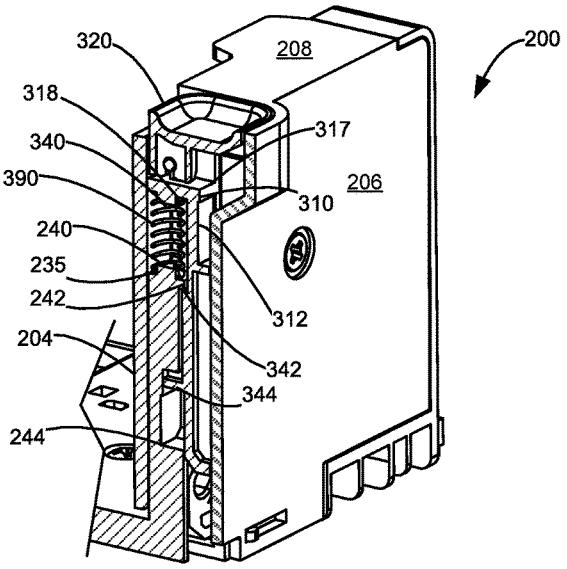
FIG. 8 is a sectioned view of the media restraint of the present disclosure illustrating the mounting of the biasing member.

Shown in FIG. 8 is the mounting of biasing member 390, shown as coil spring 390, on actuator 310. A spring seat 235 depending from front plate 204 is positioned below the spring seat 318 at the top or upper end 317 of vertical member 312. Biasing member 390 is mounted between spring seats 235, 318. Posts 240, 340 may be provided on spring seats 235, 318, respectively, and received into the respective ends of coil spring 390 keeping it in position during use of latching mechanism 300. Shown below spring seat 235 is an upper stop 242 that engages with an upper stop 342, shown as a notch 342, on vertical member 312 to limit upper travel of vertical member 312. Provided below upper stop 242 on front plate 204 is a lower stop 244 that will engage with a lower stop arm 344 extending from vertical member 312 below upper stop 342. Lower stops 244, 344 halt further downward travel of vertical member 312 when actuator 310 is depressed.

Operation of media restraint 200 will be described with reference to FIGS. 4A-8. In FIGS. 4A-5B, rear and top plates 206, 208 have been removed to show latching mechanism 300 positioned within a recess 212 provided in front plate 204. In FIGS. 4A, 5A, 6A, 7A and 8 latching mechanism 300 is shown in an engaged position with track 120B while in FIGS. 4B, 5B, 6B, and 7B latching mechanism 300 is shown in a disengaged position with respect to track 120B.

Referring to FIGS. 4A, 5A, 6A, and 7A, first and second latching cams 360A, 360B are shown in their respective first positions engaged with track 120B and actuator 310 is shown in its first position. At this first position, first and second cam followers 322A, 332B are in the upper portion of first and second slots 332A, 332B in first and second sliding cam plates 330A, 330B, respectively. First and second sliding cam plates 330A, 300B are translatable within opening 210 provided in bottom plate 202. First and second latching cams 360A, 360B are mirror images of one another and have a serrated portions 364A, 364B that engage first and second sides 120B-1, 120B-2, respectively of track 120B. As shown, latching cams 360A, 360B are plates positioned below and parallel to bottom plate 202. The second ends 372A, 372B of first and second latching cams 360A, 360B are shown pivotally attached to support plate 250. First and second pivot pins 374A, 374B are provided adjacent to second ends 372A, 372B, respectively and are received into corresponding openings 252A, 252B in support plate 250 or directly into openings 214A, 214B provided in bottom plate 202 (see FIG. 3A). Alternatively, as shown in FIG. 6B, an opening may be provided in second ends 372A. 372B, such as opening 376 shown in second end 372B that receives a pin, such as pin 254 provided on support plate 250. In lieu of pin 254, as also shown in FIG. 6B, a fastener 290 may be used to pivotally attach the first and second latching cams 360A, 360B to support plate 250 or bottom plate 202. Biasing member 390 biases actuator 310 in its first position, which, in turn, through cam followers 322A, 322B, moves sliding cam plates 330A, 330B into their respective first positions which in turn moves latching cams 360A, 360B into their respective first positions.

Figure 4B:
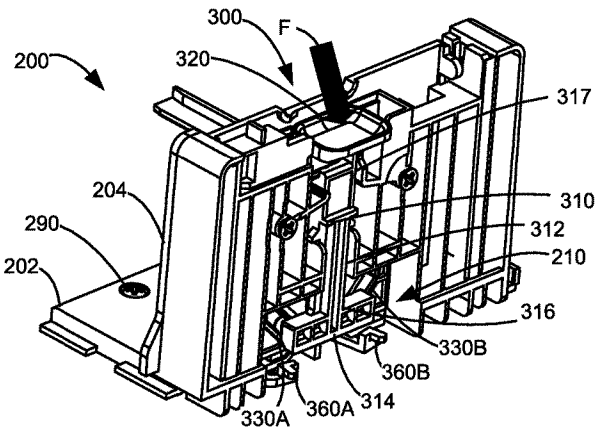
FIGS. 4A-4B are perspective rear views of the media restraint of the present disclosure with a rear plate and a top plate removed where
Figure 5B:
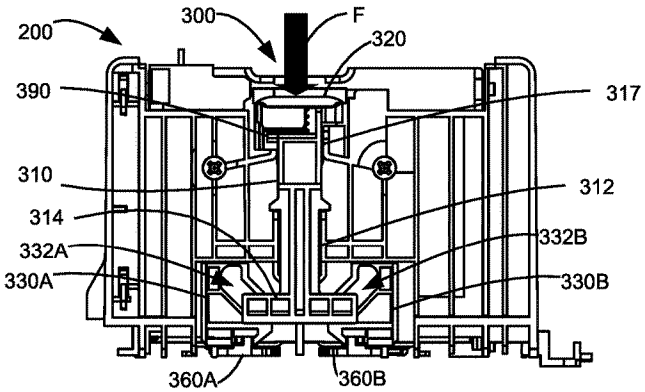
FIGS. 5A-5B are rear views of the media restraint with the rear and top plates removed and corresponding to FIGS. 4A-4B, respectively, where
Figure 4A:
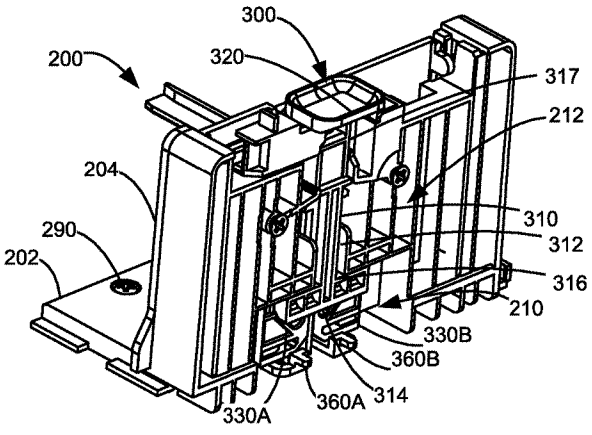
Figure 5A:
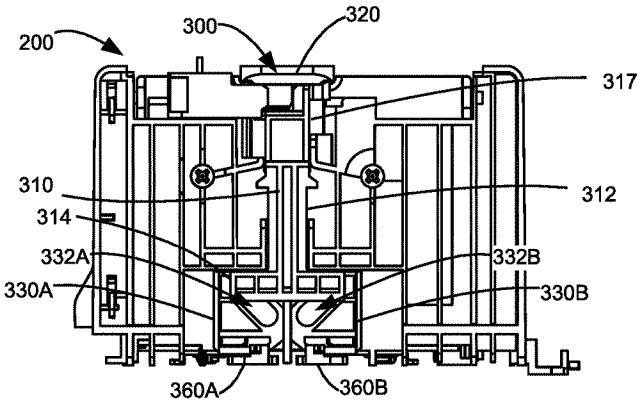
Figure 7A:
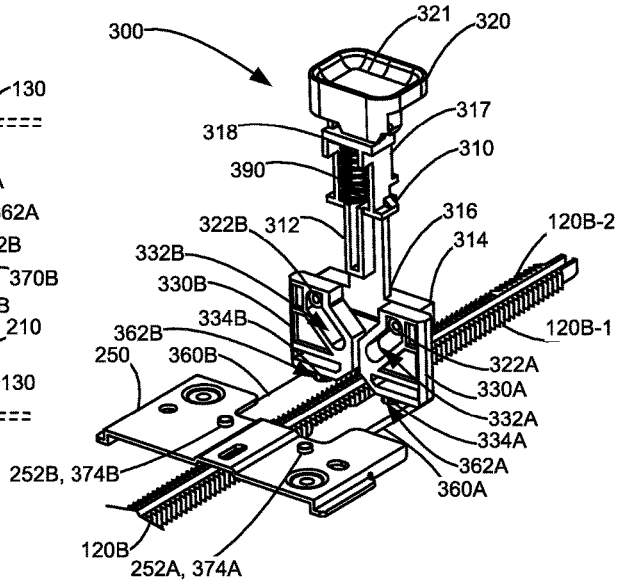
FIGS. 7A-7B are perspective views of the latching mechanism used in the media restraint of the present disclosure where

Referring to FIGS. 4B, 5B, 6B, and 7B, first and second latching cams 360A, 360B are shown in their respective second positions disengaged from track 120B. Upon application of a user-supplied downwardly-directly force F, as indicated by the black arrow in FIGS. 4B, 5B and 7B, to button 320, actuator 310 is downwardly translated from its first position compressing coil spring 390. First and second cam followers 322A, 332B move downward from the upper portion of first and second slots 332A, 332B, respectively, causing first and second sliding cam plates 330A, 330B to translate and separate. First and second pivot members 334A, 334B in turn cause first and second latching cams 360A, 360B to pivot about pivot pins 374A, 374B, respectively. This pivoting action disengages serrated portions 364A, 364B from track 120B without the use of a pinching force allowing media restraint 200 is be repositioned along track 120B. Upon removal of the user-supplied downward force F, biasing member 390 returns actuator 310, first and second sliding cam plates 330A, 330B and first and second latching cams 360A, 360B to their respective first positions. By applying the downward force F at an angle with respect to vertical in the desired direction of movement as shown in FIG. 4B, the user is able to disengage and move the media restraint 200 along the track 120B with their finger without the use of pinching.

Figure 9:
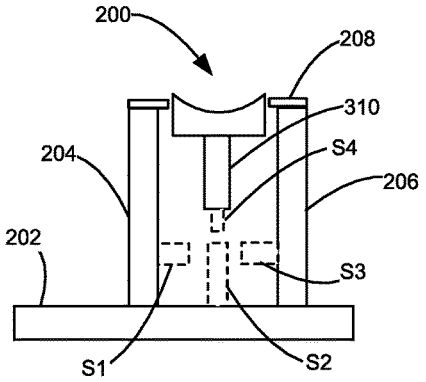
FIG. 9 is a schematic illustration of various mounting locations for stops used in the media restraint of the present disclosure.
Figure 10:
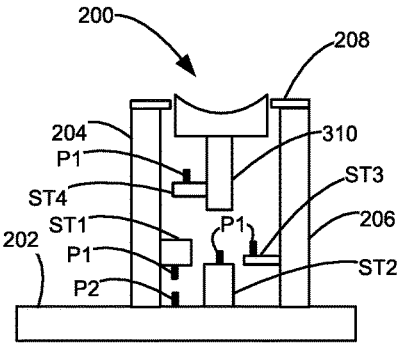
FIG. 10 is a schematic illustration of various mounting locations for seats used in the media restraint of the present disclosure.

Referring now to FIGS. 9-10, various mounting arrangements for stops and spring seats are schematically illustrated. In FIG. 9, stops S1, S2, S3 are shown mounted on the front plate 204, bottom plate 202, and rear plate 206, respectively. Stop S4 is shown depending from the bottom of actuator 310. Spring seats ST1-ST4 are used for seating biasing members in media restraint 200. In FIG. 10, spring seats ST1, ST2, ST3 are shown mounted on the front plate 204, bottom plate 202, and rear plate 206, respectively. Spring seat ST4 is shown depending from the actuator 310. Post P1 may be provided on springs seats ST1-ST4. Post P2 is shown depending from bottom plate 202. Posts P1, P2 may be used to hold biasing members on their spring seats. The number and location of the stops, spring seats, and posts are a matter of design choice and the locations shown in the figures are for the purpose of illustration and not limitation and similarly for the number and mounting of the biasing members.

For the disclosed embodiments of the media restraint, front plate 204 is shown to have the recess into which the latching mechanism 300 is mounted. As would be understood by one of ordinary skill in the art, the latching mechanism 300 may be mounted to the rear plate 206 or some components may be mounted to the front plate 204 and others to the rear plate 206. The mounting arrangement for the latching mechanism 300 is a matter of design choice and the configurations shown should not be taken as limiting. For media restraint 200, the mounting of bottom plate 202, front plate 204, rear plate 206, and top plate 208 to one another is a matter of design choice, and the configuration shown should not be viewed as limiting.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray for an imaging device, the removable media tray comprising:

a bottom surface for holding media to be fed to the imaging device;

a track having a plurality of serrations along a length thereof, the track positioned on the bottom surface; and, a media restraint slidably engageable with the track, the media restraint including:

a bottom plate having a first opening therethrough;

a front plate depending from the bottom plate;

a rear plate spaced from and attached to the front plate;

a top plate extending between the front and rear plate having a second opening therethrough; and, a latching mechanism positioned between the front, rear and top plates, the latching mechanism including:

an actuator having a vertical member and a horizontal member attached to a bottom end of the vertical member and extending outwardly from each side of the vertical member, an upper end of the vertical member having a button depending therefrom aligned with the second opening when the actuator is in a first position, the horizontal member having a first and a second cam follower depending therefrom;

a first sliding cam plate having a first angled slot and a first pivot member depending from a bottom end of the first sliding cam plate;

a second sliding cam plate having a second angled slot and a second pivot member depending from a bottom end of the second sliding cam plate;

the first and the second sliding cam plates are vertically disposed such that the first and the second cam followers are received into and are slidable along the first and the angled second slots, respectively, with the first and the second cam followers being adjacent an upper end of the first and the second angled slots when the actuator is in its first position;

a first and a second latching cam, the first and the second latching cam each having a serrated portion engaging with the track and are pivotally mounted to the bottom plate at respective first ends, the first and second latching cams having a first and a second slot, respectively, at respective second ends, the first and the second slots receiving therein the respective first and second pivot members that extend downwardly through the first opening, the first and the second latching cams having respective first positions being engaged with the track when the actuator is in its first position;

and, a biasing member for biasing the actuator and the first and the second latching cams in their respective first positions;

wherein, upon application of a user-supplied downwardly directed force to the button, the actuator moves from its first position and translates downwardly with the first and second cam followers sliding down the respective first and second angled slots pivoting the first and second latching cams about their respective first ends and away from their respective first positions and moving the serrated portions thereof away from the track allowing the media restraint to be translated along the track, and, further wherein, when the downwardly directed force is removed, the biasing member returns the actuator and the first and second latching cams to their respective first positions.

2. The removable media tray of claim 1, wherein the plurality of serrations of the track further comprise a first plurality of serrations along a first side of the track and a second plurality of serrations along a second side of the track.

3. The removable media tray of claim 2, wherein the first and second latching cams are respectively engaged with the first and second sides of the track when in their respective first positions.

4. The removable media tray of claim 1, wherein the actuator has at least one stop arm extending therefrom between the upper end of the vertical member and the horizontal member and at least one stop is provided on one of the front plate and the rear plate at a predetermined distance beneath the at least one stop arm when the actuator is in its first position, the at least one stop being aligned with the at least one stop arm.

5. The removable media tray of claim 1, wherein the button has a concave surface for receiving and holding a fingertip of a user.

6. The removable media tray of claim 1, wherein the bottom plate has a channel therein aligned with and sized to receive a second track that is parallel to the track in the media tray.

7. The removable media tray of claim 1, wherein the bottom plate has a support plate detachably fastened to a bottom surface thereof and the respective first ends of the serrated portions are pivotally attached to the support plate.

8. A media restraint for a removable media tray having a track along a bottom thereof within a media storage area, the media restraint comprising:

a bottom plate having a first opening therethrough;

a front plate depending from the bottom plate;

a rear plate spaced from and attached to the front plate;

a top plate extending between the front and rear plate having a second opening therethrough; and, a latching mechanism received between the front, rear and top plates, the latching mechanism including:

an actuator having a vertical member and a horizontal member attached to a bottom end of the vertical member and extending outwardly from each side of the vertical member, an upper end of the vertical member having a button depending therefrom and aligned with the second opening when the actuator is in a first position, the horizontal member having a first and a second cam follower depending therefrom;

a first sliding cam plate having a first angled slot and a first pivot member depending from a bottom end of the first sliding cam plate;

a second sliding cam plate having a second angled slot and a second pivot member depending from a bottom end of the second sliding cam plate;

the first and the second sliding cam plates are vertically disposed such that the first and the second cam followers are received into and are slidable along the first and the second angled slots, respectively, with the first and the second cam followers being adjacent an upper end of the first and the second angled slots when the actuator is in its first position;

a first and a second latching cam, the first and the second latching cam each having a serrated portion for engaging with the track and are pivotally mounted to the bottom plate at respective first ends, the first and second latching cams having a first and a second slot, respectively, at respective second ends, the first and second slots receiving therein the respective first and second pivot members that extend downwardly through the first opening, the first and the second latching cams having respective first positions being engaged with the track when the actuator is in its first position;

and, a biasing member for biasing the actuator and the first and the second latching cams in their respective first positions, wherein, when the media restraint is installed in the removable media tray, upon application of a user-supplied downwardly directed force to the button, the actuator slides from its first position and translates downwardly with the first and second cam followers sliding down the respective first and second angled slots pivoting the first and second latching cams about their respective first ends and away from their respective first positions and pivoting the serrated portions thereof away from the track allowing the media restraint to be translated along the track, and, further wherein, when the downwardly directed force is removed, the biasing member returns the actuator and the first and second latching cams to their respective first positions.

9. The media restraint of claim 8, wherein the first and second latching cams are respectively engaged with respective portions of a first and a second plurality of serrations along the first and second sides of the track when in their respective first positions.

10. The media restraint of claim 8, wherein the actuator has at least one stop arm extending therefrom and between the upper end of the vertical member and the horizontal member and at least one stop is provided on one of the front plate and the rear plate a predetermined distance beneath the at least one stop arm when the actuator is in its first position, the at least one stop being aligned with the at least one stop arm.

11. The media restraint of claim 8, wherein the button has a concave surface for receiving and holding a fingertip of a user.

12. The media restraint of claim 8, wherein the bottom plate has a channel therein aligned with and sized to receive a second track that is parallel to the track in the removable media tray.

13. The media restraint of claim 8 wherein the bottom plate has a support plate detachably fastened to a bottom surface thereof and the respective first ends of the serrated portions are pivotally attached to the support plate.

* * * * *